United States Patent [19]

Hsu

[11] Patent Number: 4,901,465

[45] Date of Patent: Feb. 20, 1990

[54] RIFLE GUN BARREL CLEANER

[76] Inventor: Chung-Ching Hsu, 51-2, Lane 265, Tai-Peng Rd., Taipeng Hsiang, Taichung Hsien, Taiwan

[21] Appl. No.: 302,413

[22] Filed: Jan. 26, 1989

[51] Int. Cl.[4] ..... F41C 31/00

[52] U.S. Cl. ..... 42/95; 15/104.165; 206/315.11; 206/579

[58] Field of Search ..... 42/95; 15/104.16, 104.165; 206/223, 579, 315.11; 403/165

[56] References Cited

U.S. PATENT DOCUMENTS

| | | | |
|---|---|---|---|
| 1,067,383 | 7/1913 | Southgate | 15/104.165 |
| 1,526,177 | 2/1925 | Olberding | 42/95 |
| 2,616,109 | 11/1952 | Gardner | 42/95 |
| 2,744,275 | 5/1956 | Geltner | 15/104.165 |
| 4,674,218 | 6/1987 | Bottomley | 42/95 |

FOREIGN PATENT DOCUMENTS

| | | | |
|---|---|---|---|
| 50381 | 12/1910 | Switzerland | 15/104.16 |
| 8772 | of 1896 | United Kingdom | 15/104.165 |

OTHER PUBLICATIONS

Shooting Times, Jun. 1987, pp. 60–62, 85, "Learning the Twists of Bore Cleaning".

The American Rifleman, Jan. 1977 (vol. 125, No. 1), p. 52, "Cleaning Rod Improvement".

*Primary Examiner*—Deborah L. Kyle
*Assistant Examiner*—Michael J. Carone
*Attorney, Agent, or Firm*—Ladas & Parry

[57] ABSTRACT

This invention relates to an apparatus for cleaning a gun barrel including a tubular casing having a cap covering one end thereof and a cleaning rod detachably connected to the other end thereof. The cleaning rod constitutes a plurality of sections which are detachably interconnected with one another. Several types of cleaning members are provided for being selectively and detachably connected to the cleaning rod. Whereby the dirt and powder attached to the inner surface of the gun barrel can be effectively wiped off. The apparatus for cleaning the gun barrel also can be dismantled and stored in the tubular casing.

3 Claims, 5 Drawing Sheets

RIFLE GUN BARREL CLEANER

BACKGROUND OF THE INVENTION

This invention relates to an apparatus for cleaning a gun barrel, and more particularly to an apparatus for cleaning a gun barrel which can be dismantled for storage after use and is a more effective cleaning mechanism.

Conventionally, a gun barrel is cleaned by a strip of cloth tied on the end of an elongated cleaning rod. The elongated cleaning rod is of a length which enables the strip of cloth to pass through the length of the gun barrel. However, owing to its length, the elongated cleaning rod is not convenient to store after use. In addition, the cloth sometimes separates from the cleaning rod during the cleaning process, preventing the barrel from being thoroughly cleaned.

SUMMARY OF THE INVENTION

It is therefore an object of this invention to provide an apparatus for cleaning a gun barrel which can be dismantled for storage after use.

Another object of this invention is to provide an apparatus for cleaning a gun barrel which answers the need for a more effective cleaning mechanism.

Accordingly, an apparatus for cleaning a gun barrel according to this invention includes a tubular casing having a first opened end which is covered with a removable cup, a second opened end in which a cylindrical member is integrally fixed, and a receiving chamber defined between the cap and the cylindrical member. The cylindrical member has a central bore formed therein which opens to the second end of the tubular casing. A connecting means is removably engaged in the central bore of the cylindrical member. A cleaning rod has a plurality of sections detachably connected with one another. The cleaning rod is detachably engaged with the connecting means at one end thereof. Cleaning members for wiping off dirt and powder attached onto the inner surface of the gun barrel are selectively and detachably connected to the other end of the cleaning rod. Whereby, the apparatus can be dismantled and the connecting means, the cleaning rod and the cleaning members can be stored in the receiving chamber of the tubular casing after use.

Furthermore, the cleaning members comprise a set of cylindrical wipers and a set of barrel-cleaning brushes. Each of the cylindrical wipers has a plurality of spaced inclined grooves and a sharp projection for wiping off the dirt and the powder and holding a strip of cloth wrapped on the cylindrical wiper so as to prevent separation of said cloth from said wiper. The barrel-cleaning brushes are used for wiping off the dirt and the powder existing in the gun barrel. By using these, the gun barrel can be effectively cleaned.

BRIEF DESCRIPTION OF THE DRAWINGS

Other features and advantages of this invention will become apparent in the following detailed description of a preferred embodiment of this invention with reference to the accompanying drawings, in which.

DETAILED DESCRIPTION OF A PREFERRED EMBODIMENT

Figure 1:
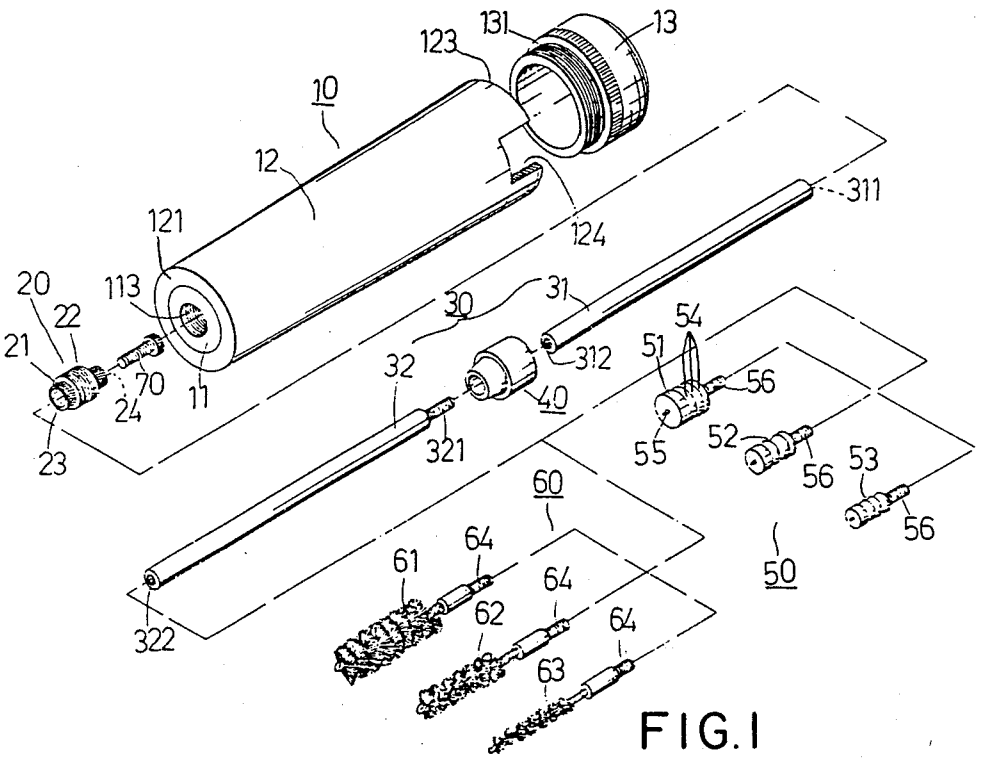
FIG. 1 is a perspective exploded view of a preferred embodiment of an apparatus for cleaning a gun barrel according to this invention.
Figure 2:
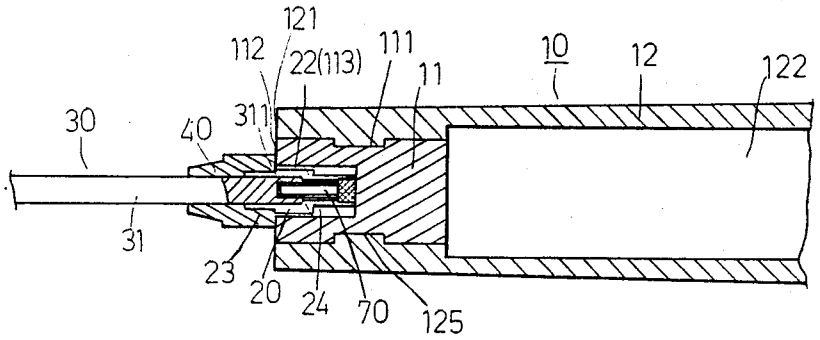
FIG. 2 is a sectional view of a preferred embodiment of an apparatus for cleaning a gun barrel according to this invention.

Referring to FIGS. 1, 2, an apparatus for cleaning a gun barrel includes a handle portion 10, a connecting member 20, a cleaning rod 30, a frusto-concial rubber sleeve 40, a set of cylindrical wipers 50 and a set of barrel-cleaning brushes 60. The handle portion 10 comprises a tubular casing 12, with front and rear opened ends 121, 123, which is made of a plastic material such as PVC (polyvinyl chloride). A cylindrical member 11 with a threaded central bore 113, which is made of suitable metal, such as iron and stainless steel, is integrally fixed in the front end 121 of the tubular casing 12. In this case, the cylindrical member 11 has a groove 111 formed radially inward around the outer surface thereof. The groove 111 of the cylindrical member 11 is adapted to match with a flange 125 so as to prevent separation from the tubular casing 12. A cap 13, with a threaded insert end 131, may be threaded into a threaded portion 124 formed inside the rear end 123 of the tubular casing 12 so as to cover the rear end 123 of the tubular casing 12. A receiving chamber is defined between the cap and the cylindrical member 12 for storage.

The connecting member 20 is in the form of a sleeve having a bore 23 formed therein. The sleeve 20 has a threaded section 22 protruded around the outer surface 21 thereof for being threaded into the central bore 113 of the cylindrical member 11. A counter bore 24 is provided in one end of the sleeve 20, which is to be encased in the central bore 113 of the cylindrical member 11, and communicates with the bore 23 of the sleeve 20. The cleaning rod 30, which is made of a rigid metal, constitues a first and a second section 31, 32. The first section 31 of the cleaning rod 30 has two oppositely threaded bores 311, 312. The second section 32 of the cleaning rod 30 has a threaded insert end 321 and an oppositely threaded bore 322. The first and second sections 31, 32 of the cleaning rod 30 are connected by the interengagement of the threaded bore 312 of the first section 31 and the threaded insert end 321 of the section 32. The first section 31 of the cleaning rod 30 is connected to the sleeve 20 by inserting one end of the first section 31 into the bore 23 of the sleeve 20 so that a screw 70, mounted in the counter bore 24 of the sleeve 20, can be threaded into the threaded bore of the first section 31. The set of cylindrical wipers 50, which are made of copper, include three cylindrical wipers 51, 52, 53 being of different diameters. Each of the cylindrical wipers has a plurality of spaced inclined grooves 54 annularly formed thereon, a pointed projection 55 protruded from one end thereof and a threaded insert 56 formed on the other end thereof for interconnecting with the threaded bore 322 of the second section 32 of the cleaning rod 30. The set of barrel-cleaning brushes 60 include three barrel-cleaning brushes 61, 62, 63 of different sizes. The frusto-conical rubber sleeve 40 passes through the cleaning rod 30 and then is sleeved onto one end of the sleeve member 20 when said sleeve member 20 is connected with the cleaning rod 30 and threaded into the central bore 113 of the cylindrical member 11. In this way the frusto-conical rubber sleeve rubber 40 will act as a cushion between the handle portion 10 and the gun barrel when the cleaning rod 30 is reciprocating in the gun barrel.

Figure 3:
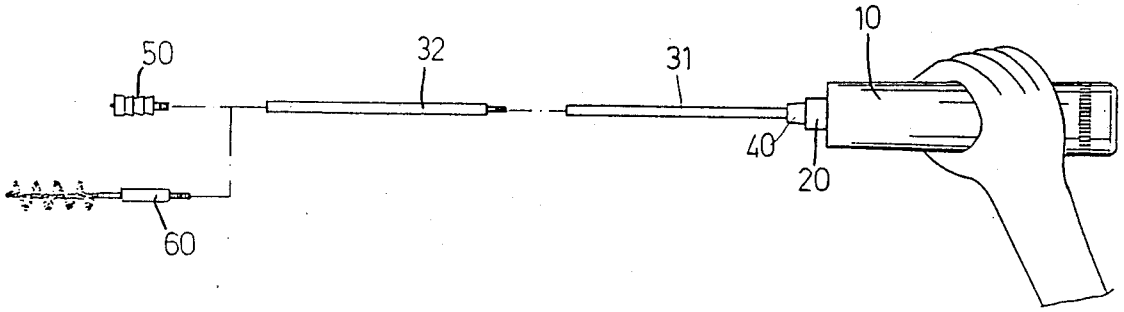
FIG. 3 is a schematic view showing the assembly of the apparatus for cleaning a gun barrel according to this invention.
Figure 4A:
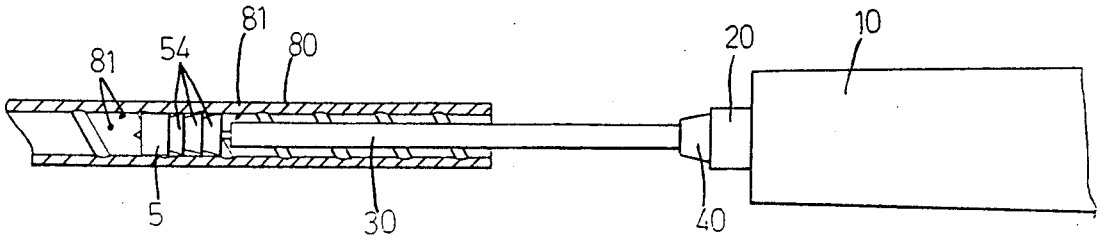
FIGS. 4(A) to 4(C) are schematic views showing the cleaning member of the apparatus for cleaning a gun barrel in an operative position.
Figure 4B:
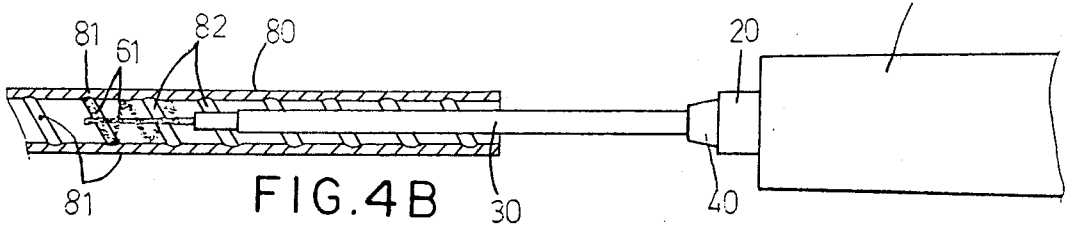
Figure 4C:
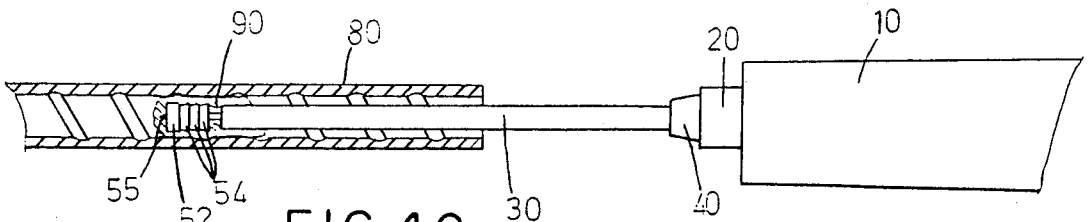

Referring now to FIG. 3, a schematic view of the assembly of the apparatus for cleaning a gun barrel is shown. To achieve this effect, the first section 31 is connected to the sleeve member 20 in a manner described hereinbefore, and then the sleeve member is threaded into the central bore 113 of the cylindrical member 11. The rubber sleeve 40 passes through the first section 31 and is sleeved onto the sleeve member 20. The second section 32 of the cleaning rod 30 is then connected to the first section 31 of the cleaning rod 30. One of the cylindrical wipers 50 and one of the barrel-cleaning brushes 60 is selectively connected to the free end of the cleaning rod 3 for cleaning the gun barrel as will be described hereinafter.

The procedures of cleaning a gun barrel are generally carried out as following:

(A) The cylindrical wiper 51, which is of an outer diameter equal to the inside diameter of the gun barrel designated generally by 80, is inserted into the gun barrel 80 and is reciprocated in the gun barrel 80 by shifting the handle portion 10 associated with the cleaning rod 30 so as to wipe off the dirt and powder 81 attached to the inner surface of the gun barrel 80.

(B) The cylindrical wiper 51 in step (A) is then replaced by the barrel-cleaning brush 61. To wipe off the dirt and powder 81 attached in the rifle 82 of the gun barrel 80, the barrel-cleaning brush 61 is shifted and rotated by in turn shifting and rotating the handle portion 10 associated with the cleaning rod 30 in the gun barrel.

(C) The barrel-cleaning brush 61 in step (B) is replaced by another cylindrical wiper 52 which is of a smaller diameter than the inside diameter of the gun barrel 80. The cylindrical wiper 52 is wrapped by a piece of cloth 90 provided with anti-corrosive oil and is reciprocated in a manner as described in step (A) so as to apply the anti-corrosive oil upon the inner surface of the gun barrel 80. It is noted that since the cylindrical wiper is provided with annular grooves 54 and a sharp projection 55 for holding the cloth 90, the piece of cloth will not separate from the cylindrical wiper 52 when the cylindrical shifts along the gun barrel 80.

Figure 5:
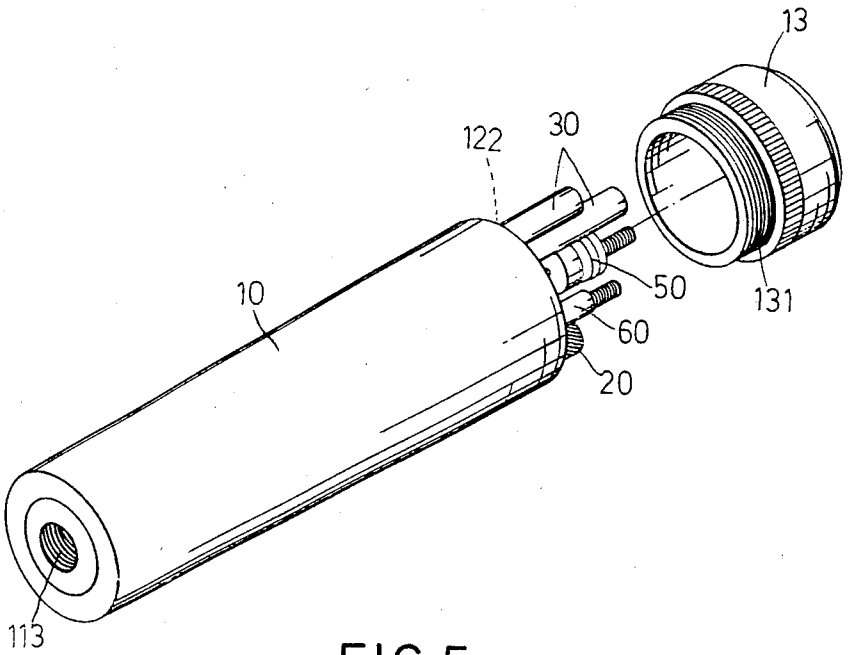
FIG. 5 is a schematic view showing the apparatus for cleaning a gun barrel in a storing position.

After cleaning, the apparatus for cleaning the gun barrel can be dismantled by reversing the order of assembly which was described hereinbefore. Therefore, the parts of the apparatus including the connecting member 20, the first and second sections of the cleaning rod 30, the set of cylindrical wipers 50 and the set of barrel-cleaning brushes 60, can be stored in the receiving chamber 122 of the handle portion 10, as best illustrated in FIG. 5.

With this invention thus explained, it is apparent that numerous modifications and variations can be made without departing from the scope and spirit of this invention. It is therefore intended that this invention be limited only as indicated in the appended claims.

We claim:

1. An apparatus for cleaning a gun barrel, said apparatus comprising:

a tubular casing having a first opened end covered with a removable cap, a second opened end in which a cylindrical member is integrally fixed, and a receiving chamber defined between said cap and said cylindrical member, said cylindrical member having a threaded central bore formed therein which opens to said second end of said tubular casing;

a connecting means which includes a sleeve having a threaded outer surface for being threaded into said threaded central bore;

a cleaning rod having a plurality of sections detachably connected with one another, said cleaning rod detachably engaged with said connecting means at one end thereof, wherein said cleaning rod is inserted into one end of said sleeve at the end of said cleaning rod on which a threaded bore is formed, the other end of said sleeve having a counter bore in which a screw is mounted so as to be threaded into said threaded bore at the end of said cleaning rod and enable said cleaning rod to engage with said sleeve, and one of said sections of said cleaning rod, which is connected with said sleeve, has two oppositely threaded bores, each of the remaining sections of said cleaning rod having a threaded insert end and an oppositely threaded bore, said sections of said cleaning rod being interconnected by the interengagement of said threaded bores and said threaded insert ends; and cleaning members for wiping off dirt and powder attached to the inner surface of the gun barrel, said cleaning members being selectively and detachably connected to the other end of said cleaning rod; whereby said apparatus can be dismantled and said connecting means, said cleaning rod and said cleaning members can be stored in said receiving chamber of said tubular casing after use.

2. An apparatus as claimed in claim 1, wherein said cleaning members include a set of cylindrical wipers, each of said cylindrical wipers having a plurality of spaced inclined grooves annularly formed thereon, a pointed projection protruded from one end thereof and a threaded insert formed on the other end thereof for interconnecting with one of said threaded bores of said sections.

3. An apparatus as claimed in claim 2, wherein each of said cleaning members further has a set of barrel-cleaning brushes having a threaded insert formed on one end thereof so as to interconnect with one of said threaded bores of said sections.

* * * * *